US006002091A

United States Patent [19]

Reneau

[11] Patent Number: 6,002,091

[45] Date of Patent: Dec. 14, 1999

[54] BI-DIRECTIONAL SHOCK SENSOR EMPLOYING REED SWITCH

[75] Inventor: Daniel R. Reneau, Madison, Wis.

[73] Assignee: Breed Automotive Technology, Inc., Lakeland, Fla.

[21] Appl. No.: 09/195,724

[22] Filed: Nov. 18, 1998

[51] Int. Cl.[6] ..... H01H 35/14

[52] U.S. Cl. ..... 200/61.45 M

[58] Field of Search ..... 73/1.37, 1.38, 73/514.01, 514.16, 514.38, 514.39; 200/61.45 R–61.45 M; 335/205–207

[56] References Cited

U.S. PATENT DOCUMENTS

| | | | |
|---|---|---|---|
| 3,559,124 | 1/1971 | Posey | 335/205 |
| 3,601,729 | 8/1971 | Hierta | 335/205 |
| 4,484,041 | 11/1984 | Andres et al. | 200/61.45 M |
| 4,518,835 | 5/1985 | Grossar | 200/61.45 M |
| 4,639,563 | 1/1987 | Gunther | 200/61.45 M |
| 4,705,922 | 11/1987 | Seeger et al. | 200/61.45 M |
| 4,820,888 | 4/1989 | Shields | 200/61.45 M |
| 4,965,416 | 10/1990 | Bachmann | 200/61.45 R |
| 5,194,706 | 3/1993 | Reneau | 200/61.45 M |
| 5,248,861 | 9/1993 | Kato et al. | 200/61.45 M |
| 5,416,293 | 5/1995 | Reneau | 200/61.45 M |
| 5,422,628 | 6/1995 | Rodgers | 340/573 |
| 5,440,084 | 8/1995 | Fuse et al. | 200/61.45 R |
| 5,581,060 | 12/1996 | Kobayashi et al. | 200/61.45 M |
| 5,675,134 | 10/1997 | Swart et al. | 200/61.45 M |

*Primary Examiner*—Michael Friedhofer
*Attorney, Agent, or Firm*—Lonnie R. Drayer; Patrick Stiennon

[57] ABSTRACT

A bidirectional shock sensor is constructed from a reed switch positioned between two shock sensing magnets. Each magnet is an annular ring which travels parallel to the reed switch reeds on a shaft spaced in a direction perpendicular to the axis of the reed switch. A spring pre-loads a first magnet against a first stop. A second spring pre-loads a second magnet against a second stop. The direction of travel of the first and second magnets is opposite and the first and second stops are positioned at opposite ends and on opposite sides of the reed switch. The magnets and the shafts on which they travel are positioned on identical housings which are arranged as mirror images with the reed switch positioned therebetween.

14 Claims, 3 Drawing Sheets

BI-DIRECTIONAL SHOCK SENSOR EMPLOYING REED SWITCH

CROSS REFERENCES TO RELATED APPLICATIONS

STATEMENT AS TO RIGHTS TO INVENTIONS MADE UNDER FEDERALLY SPONSORED RESEARCH AND DEVELOPMENT

BACKGROUND OF THE INVENTION present invention relates to shock sensors in general and shock sensors employing reed switches in particular.

Reed switches have found wide use in shock sensors, particularly as safing sensors in automobiles. Typically automobile crash sensing is performed by integrated micro device sensors which are incorporated onto chips which assess the magnitude and direction of the crash and employ preprogrammed logic to decide whether and how to deploy or activate various safety systems. These systems include air bags and seat belt retractors. Such micro sensors can be very cost-effectively incorporated into a safety system logic. However, such small scale devices are subject to electromagnetic interference and related phenomenon giving rise to possible false sensor outputs.

The need for a macro scale sensor arises to provide a safing sensor which provides the programmed logic with an indication that a crash of sufficient magnitude to warrant deployment of safety systems is in fact occurring. Shock sensors employing reed switches meet the need for a large scale device while at that the same time allowing a relatively small sized package which can be directly mounted onto a circuit board. A reed switch is resistant to electromagnetic interference and the hermetic seal formed by the glass capsule about the reeds results in a highly reliable switch which is sealed from the atmosphere. Thus, reed switch based shock sensors are usually the design choice for safing sensors forming part of a vehicle safety system.

Reed switch based shock sensors have been designed with multiple axes of sensitivity, yet such devices are typically considerably more expensive than unidirectional shock sensors or are more sensitive to large scale vibration. A typical reed switch based shock sensor has an acceleration sensing magnetic mass which is held against a stop by a spring. The spring is typically pre-loaded so that no motion of the sensing mass takes place unless the acceleration loads exceed a selected value. Obtaining pre-loaded sensing masses in a bidirectional shock sensor has proven problematic.

SUMMARY OF THE INVENTION

The bidirectional shock sensor of this invention employs a reed switch positioned between two shock sensing magnets. Each magnet is an annular ring which travels parallel to the reed switch reeds on a shaft positioned within a housing. A spring pre-loads a first magnet against a first stop. A second spring pre-loads a second magnet against a second stop. The direction of travel of the first and second magnets is opposite and the first and second stops are positioned at opposite ends and on opposite sides of the reed switch. The reed switch has staple formed leads, the first stable formed lead is inserted into a passageway in a first housing holding the first magnet. The second staple formed lead is inserted into a second housing holding the second magnet, the first and second housings are folded to enclose the reed switch and position the reed switch between the parallel shafts on which the shock sensing magnets ride. The housings may be identical and positioned with respect to each other as mirror images. The housings are held together by a wire strap which has the form of a staple which crosses the reed switch and, like the reed switch, the leads of the staple fit into passageways in the first and second housings. By diagonally crossing the reed switch, the strap locks the housings together in the collapsed position. A pressure-sensitive label or tape extends between the housings and holds the strap and the housings in place. When the shock sensor is soldered to a circuit board the reed switch and the strap are further fixed in place.

A single housing with a single magnet may form a unidirectional shock sensor with a reed switch cover which serves to lock the reed switch parallel to the single shaft on which a single, somewhat larger, shock sensing magnet is mounted.

It is a feature of the present invention to provide a shock sensor with bidirectional shock detection.

It is a further feature of the present invention to provide a shock sensor with cooperating magnetic elements.

It is another feature of the present invention to provide a bidirectional shock sensor with simplified assembly and alignment.

It is a still further feature of the present invention to provide a shock sensor which mounts directly on a circuit board, has a small footprint, and is low cost.

Further objects, features and advantages of the invention will be apparent from the following detailed description when taken in conjunction with the accompanying drawings.

DESCRIPTION OF THE PREFERRED EMBODIMENTS

Figure 1:
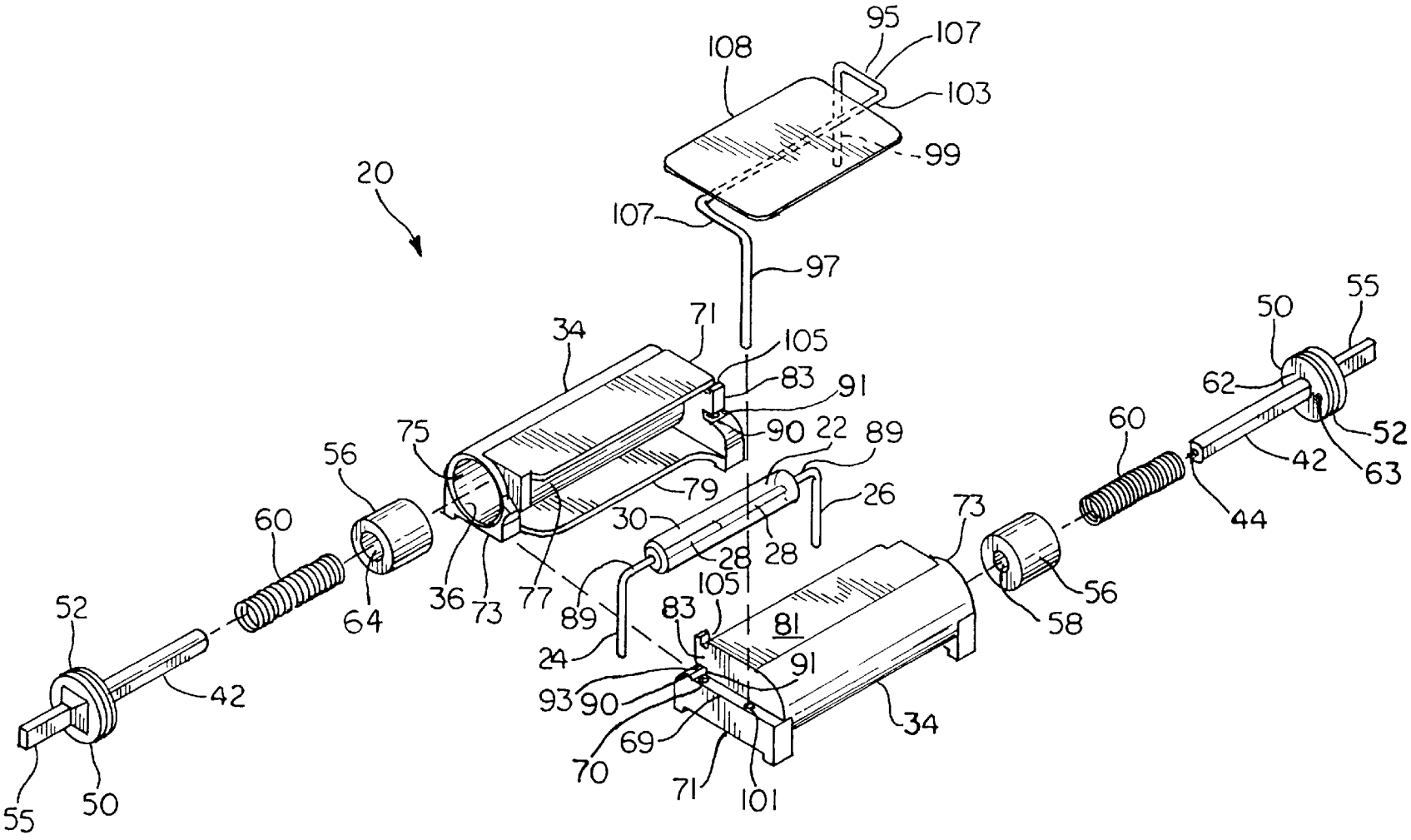
FIG. 1 is an exploded isometric view of the shock sensor of this invention.
Figure 2:
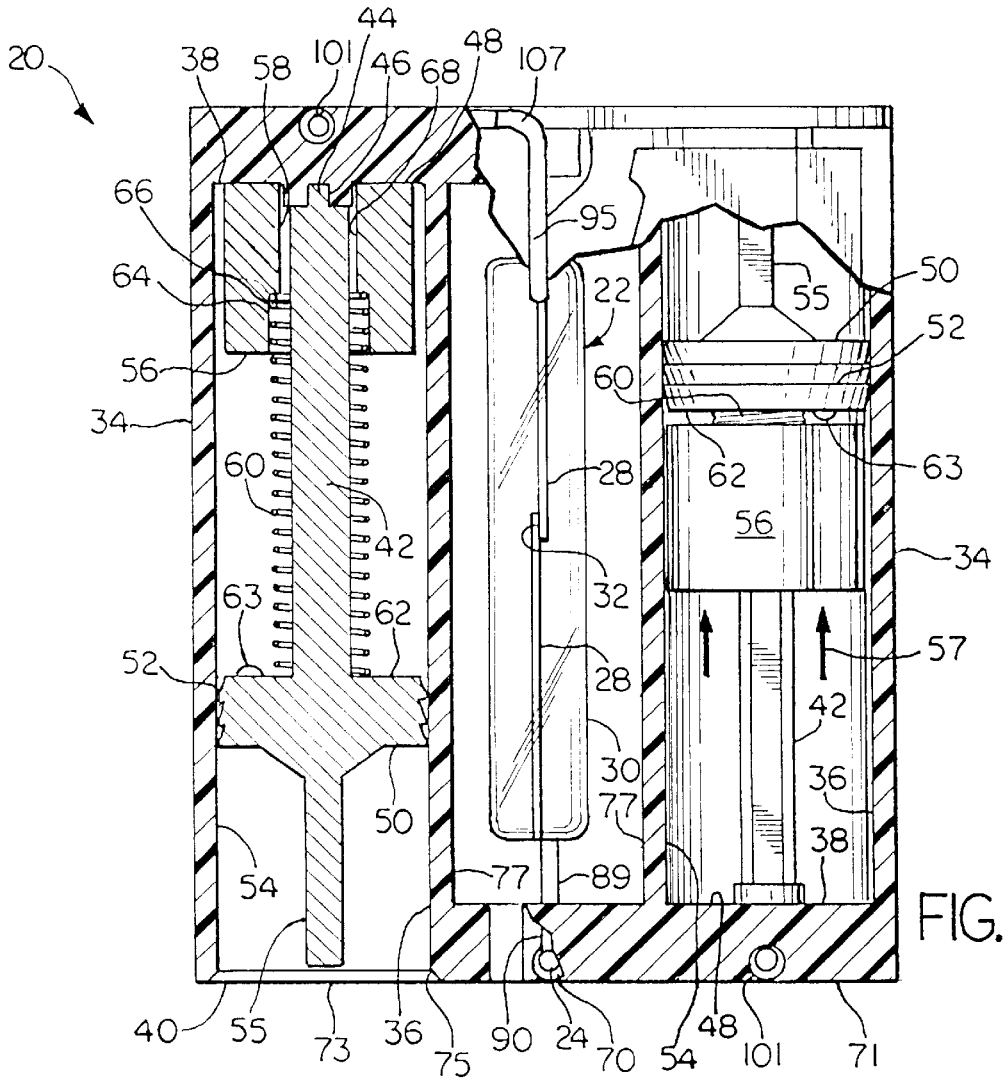
FIG. 2 is a top plan view, part cut-away in section on multiple planes of the shock sensor of FIG. 1, showing the sensor in a shock-responsive position.

Referring more particularly to FIGS. 1–4, wherein like numbers refer to similar parts, a shock sensor 20 is shown in FIGS. 1 and 2. As shown in FIG. 1, the shock sensor 20 has a single reed switch 22 which is disposed between two identical housings 34, each of which contain a magnetic shock sensing mass which is disposed for sliding along axes parallel to the reed switch. The reed switch 22 has a first staple formed lead 24 at one end, and a second staple formed lead 26 at the other end. The leads 24, 26 are connected to, and are actually co-formed with, ferromagnetic reeds 28 which are positioned within a glass capsule 30 which hermetically seals the reeds therewithin. The reeds 28 terminate at overlapping contact surfaces 32 which are spaced apart when the switch is in an unactivated condition, and which are brought into engagement in the presence of a magnetic field which causes the reeds 28 to attract.

The housings 34 are preferably identical injection molded plastic parts, one positioned on either side of the reed switch 22. Each housing 34 defines a cylindrical cavity 36 which has an axis which is generally parallel to the reed 28 in the assembled sensor 20. As shown in FIG. 2, each cavity 36 terminates at a blind end 38 opposite an open end 40. A molded shaft 42 is positioned along the axis of each cylindrical cavity 36. The shaft preferably has semicylindrical portions which are joined by parallel planar segments. Each shaft 42 has a protruding terminal key 44 which engages within a protruding annular keyway 46 which extends from the center of the surface 48 defining the blind end of the cavity 36. The engagement of the shaft key 44 within the keyway 46 serves to position the shaft 42 along the axis of the cylindrical cavity 36.

Each shaft 42 extends from a generally cylindrical disk 50, the disk may be composed of an array of frustoconical barbs 52 which deform when inserted into the cylindrical cavity 36 to engage the cylindrical wall 54 of the cavity. A gripping extension 55 extends outwardly from each disk 50. The gripping extensions 55 allow the shafts to be mechanically held and positioned. Although the disks 50 and the attached shafts 42 may be held in place by potting around the gripping extensions 55, the frustoconical barbs 52 alone may be sufficient to lock the disks 50 in place.

A generally annular or ring-shaped magnet 56 having a central opening 58 is positioned about each shaft 42. A spring 60 extends between each magnet 56 and an inner face 62 of the disk 50, thereby biasing the magnet 56 against the surface 48 which forms the blind end 38 of the cylindrical cavity 36. A small protrusion 63 or nubbin extends toward the blind end 38 from the inner face 62 of the disk 50. The small protrusion 63 serves to reduce bounce from the inner face 62 when the magnet 56 collides with the face 62 due to a crash shock. By causing magnet to cock to one side, the protrusion 63 causes an engagement between the magnet 56 and the shaft 42 which dissipates energy, thus reducing bounce and increasing the switch dwell time.

Each magnet 56 has an enlarged portion 64 of the central opening 58 which accommodates the spring 60 between the shaft and the magnet 56. The spring 60 is retained against the magnet 56 by a radially extending surface 66 which connects the enlarged portion 64 of the opening with a narrower portion 68 of the central opening 58. Shaping of the magnet as described in my earlier U.S. Pat. No. 5,212,357, which is incorporated herein by reference, can also increase the dwell time.

The shock sensor 20 achieves bidirectional shock sensing with two mechanically independent sensing masses 56. Each magnetic sensing mass 56 is pre-loaded against a surface 48, and thus is not subject to vibration-induced motion which does not exceed the pre-load. The sensing masses 56 do interact electro-mechanically through their action on the individual reeds 28. When the sensing magnetic masses 56 are in their rest positions the magnetic field which they produce permeates the adjacent reeds 28. This reduces the size of the magnet 56 needed to cause closure of the reed switch 22. By reducing the size of the magnets 56 the entire package is reduced in size, thus lowering cost and improving packaging efficiency.

As shown in FIG. 2, when the shock sensor experiences a front end crash, the magnet 56 has apparent motion towards the inner face 62 of the disk 50 as indicated by arrow 57. In a front end crash, acceleration takes place in a direction from front to rear in the automobile. As the magnet 56 is unconstrained along an axis defined by the shaft 42, except by the spring 60, it is not accelerated to the same degree as the housing 34. This produces the apparent motion of the magnet 56, acting as an acceleration sensing mass, towards the site of the crash, thereby moving the magnet 56 against the abutment or stop formed by the surface 62. Motion of the magnet 56 relative to the reed switch 22 causes the reeds 28 to attract causing closure of the reed switch 22.

The housings 34 are arranged so that the magnets 56 contained in opposed housings are biased by the springs 60 against surfaces 48 or abutments on the housing which are diametrically opposed. Thus a forward crash as shown in FIG. 2 causes the right magnet to move towards the second surface 62. A rear end crash will cause the left magnet to move towards the second surface 62. Thus a shock sensor 20 having two directions of sensitivity one-hundred-and-eighty degrees apart is provided.

Simplicity, and experience with similar actuation mechanisms, seeing for example by earlier patents U.S. Pat. Nos. 5,416,293 and 5,194,706, provides assurance of functionality. The automobile industry typically looks for sensors with mechanical simplicity combined with low cost and ability to accommodate changes in design parameters. Design parameters are readily adjusted in the sensor 20 by varying the spring constant and the magnet size or type. Typically, the magnets for cost reasons will be formed of metal particles embedded in plastic. Nevertheless, cast or powder metallurgy produced magnets may be used.

Each housing 34 has a ledge 69, as shown in FIG. 1, which runs along a side 71 of the housing 34 opposite the side 73 in which the opening 75 to the cavity 36 is formed. The ledge 69 has a first hole 70 which extends vertically through the ledge and the housing. The first hole 70 is adjacent a reed switch accepting face 77 of the housing 34. A lower shelf 79 extends from the lower portion of the face 77. The lower shelf 79 adjoins and reinforces the side 71 of housing which contains the first hole 70. An upper shelf 81 extends from the upper portion of the face 77 in spaced parallel relation to the lower shelf 79. The upper shelf 81 reinforces a portion 83 of the side 71 which is stepped back from the ledge 69.

Figure 3:
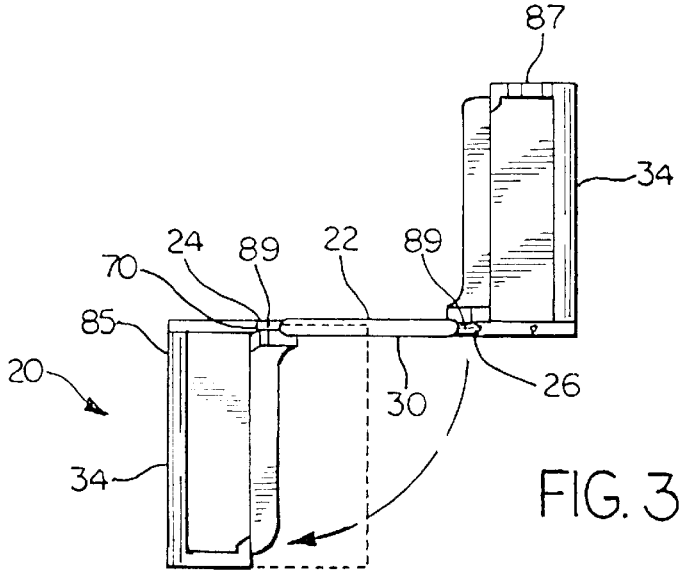
FIG. 3 is a reduced scale illustrative top plan view showing the reed switch connecting in the two housing halves of the shock sensor of FIG. 1 in a uncollapsed positioned prior to the final assembly position shown in phantom view.

As shown in FIG. 3, two identical housings 34 are joined to form the shock sensor 20 by placing the first lead 24 of the staple formed reed switch 22 through a first hole 70 on a first housing 85, and by placing the second lead 26 through a first hole 70 on a second housing 87. The identical housings 85, and 87 are brought into inverse mirror image engagement by pivoting the housings. As the reed switch 22 is brought into parallel engagement with the sides 77 of the housings 85, 87, a portion 89 of each lead 24, 26 which extends horizontally from the reed switch glass capsule 30 is captured by a slot 91 which has a lower surface 90 coplanar with the ledge 69 and an upper surface 93 spaced from the lower surface 90 which positions the reed switch in the vertical plane thereby assuring repeatable positioning of the reed switch with respect to both housings 85, 87.

A strap 95 having a first vertical lead 97 and a second vertical lead 99 extends across the reed switch 22. The first vertical lead 97 is positioned in a second hole 101 in the ledge 69 of the first housing 85. Similarly the second vertical lead 99 is positioned in a second hole 101 in the second housing 87. The strap has a horizontal section 103 which extends over the reed switch 22 along an interface formed where the upper shelves 81 terminate. A notch 105 is formed in the portion 83 of the side 71 above the slot 91. The notch 105 receives the horizontal section 103 of the strap 95. Short transverse sections 107 connect the horizontal section 103 of the strap 95 to the vertical leads 97, 99. Once pivoted into engagement with one another and connected with the strap 95, the two housings 34 are held together by a pressure-sensitive adhesive label or piece of tape 108 which overlies the opposed upper shelves 81. The label 108 holds the strap 95 and the housings 34 in position.

To be cost effective, a shock sensor must be designed for automatic assembly. The shock sensor 20 incorporates interlocking parts which can be assembled without bonding or potting. The label 108 does not require a narrowly controlled environment or time to cure, and is thus compatible with rapid automatic assembly. Tolerances are achieved through self alignment between the reed switch 22 and the housings 34.

Figure 4:
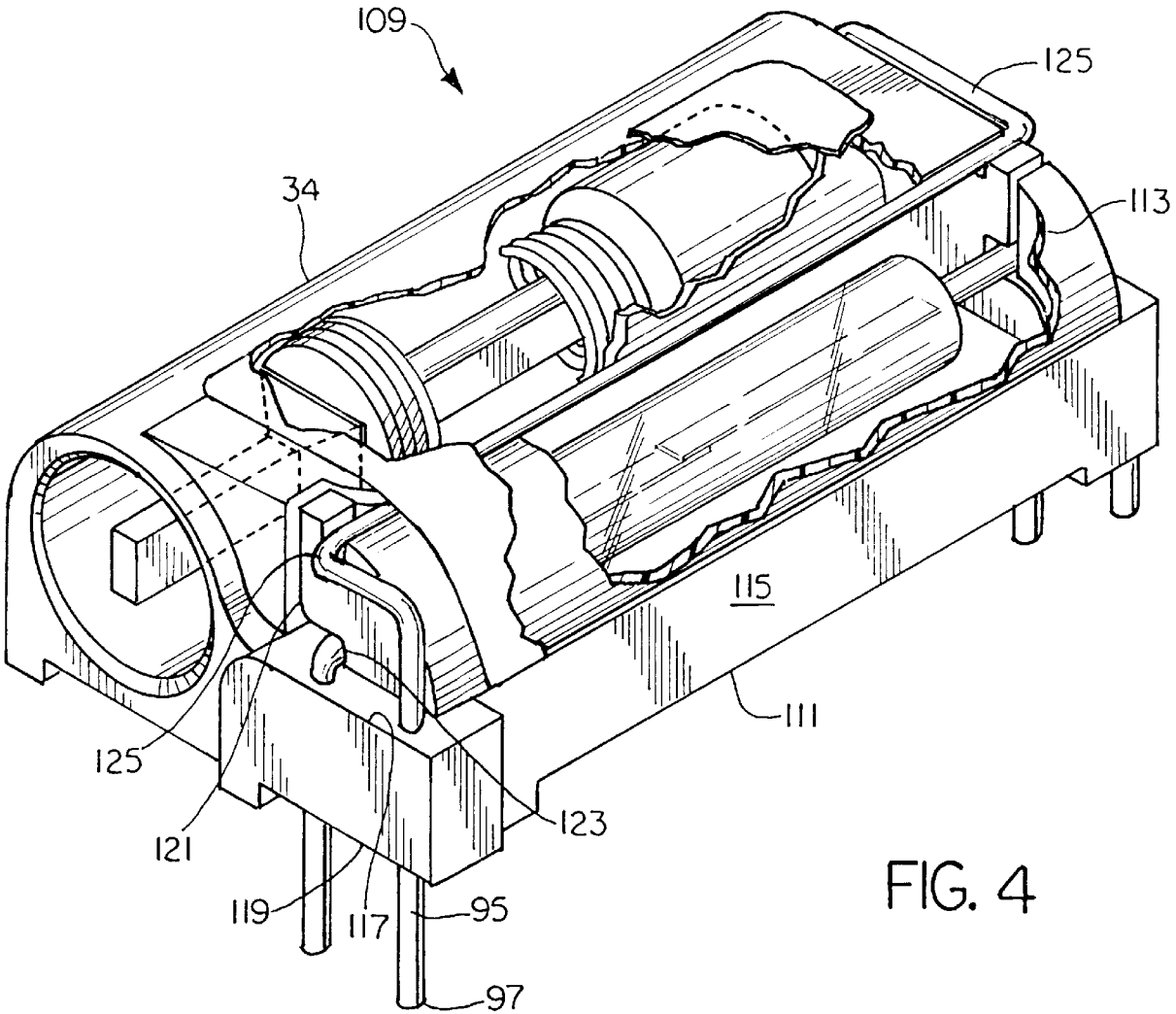
FIG. 4 is an isometric view, partially cut-away in section, of an alternative embodiment of the shock sensor of this invention providing unidirectional shock detection.

An alternative embodiment shock sensor 109, shown in FIG. 4, employs a single housing 34 together with a housing closure 111. The closure 111 has an upper shelf 113 which is semicylindrical in shape, and which extends down to the body 115 of the closure 111. The closure 111 has a ledge 117 similar to the ledge 69 formed on the housing 34. The ledge 117 has a first hole to receive the second lead 26 on the reed switch 22, the side 119 of the closure 111, has a portion 121 which forms a reed switch positioning slot 123 and a strap positioning notch 125 similar to those on the housing 34. Because only a single magnet is present it will typically need to produce a greater magnetic field than the same magnet used in the shock sensor 20.

It should be understood that the springs 60 which are placed in the identical housings 34 could have differing spring constants which would allow tailoring of the sensitivity in one direction verses sensitivity in the opposite direction. If this technique was used, to prevent confusion two housings 34 having different appearances and keying features would be employed.

It should be understood that the shock sensors described herein are not limited to the use of identical housings arranged in mirror image but includes shock sensors wherein the housing on which the acceleration sensing masses and the reed switch are mounted may be a unitary whole or may be constructed from two or more separate housings which differ in various respects from each other.

It should be understood that wherein the reed switch is described normally open so that movement of the acceleration sensing magnetic mass causes the reed switch to close, movement of the acceleration sensing mass could be used to open a normally closed reed switch.

It is understood that the invention is not limited to the particular construction and arrangement of parts herein illustrated and described, but embraces such modified forms thereof as come within the scope of the following claims.

I claim:

1. A shock sensor comprising:

a housing;

a reed switch mounted on the housing, the reed switch having reeds which define an axis along which the reeds lie;

a first shaft mounted on the housing in spaced parallel relation to the reed switch axis;

portions of the housing defining a first surface perpendicular to the shaft terminating the shaft in a first direction;

portions of the housing defining a second surface perpendicular to the first shaft and spaced from the first surface, the second surface terminating the shaft in a second direction;

a first magnet which functions as an acceleration sensing mass, the first magnet being mounted about the first shaft and movable on the first shaft between the first surface and the second surface; and a first spring extending about the first shaft, and extending between the second surface and the magnet to pre-load the magnet against the first surface, wherein a first acceleration causes the magnet to slide along the first shaft towards the second surface and cause actuation of the reed switch.

2. The shock sensor of claim 1 further comprising:

a second shaft mounted on the housing in spaced parallel relation to the axis defined by the reed switch;

portions of the housing defining a third surface which is perpendicular to the second shaft and terminating the second shaft in the second direction opposite the first direction;

portions of the housing defining a fourth surface perpendicular to the second shaft and spaced from the third surface, the fourth surface terminating the second shaft in the first direction;

a second magnet which functions as an acceleration sensing mass, the second magnet being mounted about the second shaft and movable on the second shaft between the third surface and the forth surface; and a second spring positioned on the second shaft and extending between the fourth surface and the magnet to pre-load the magnet against the third surface, wherein a second acceleration force in a direction opposite from the first acceleration causes the magnet to slide along the shaft towards the fourth surface thus causes actuation of the reed switch.

3. The shock sensor of claim 2 wherein the housing is comprised of a first housing member and a second housing member, and wherein the first magnet is mounted to the first housing member and the second magnet is mounted to the second housing member, and wherein the reed switch is mounted to both the first housing member and the second housing member.

4. The shock sensor of claim 3 wherein the first housing member is substantially identical to the second housing member and the first housing member and the second housing member are arranged as mirror images with the reed switch positioned therebetween.

5. The shock sensor of claim 4 wherein the reed switch has a first staple formed lead and a second staple formed lead and wherein the first staple formed lead is linked to the first housing member, and the second staple formed lead is linked to the second housing member.

6. The shock sensor of claim 3 further comprising a metal strap which crosses over the reed switch and mechanically engages both the first housing member and the second housing member.

7. The shock sensor of claim 1 further comprising portions of the housing forming a cylindrical cavity having a cylindrical wall, the shaft extending along an axis defined by the cylindrical cavity, the magnet being movable on the shaft within the cylindrical cavity.

8. The shock sensor of claim 7 wherein the second surface is formed on a disk shaped portion of the housing which is formed integrally with the first shaft.

9. The shock sensor of claim 8 wherein the disk has circumferential generally conical barbs which engage with the cylindrical wall of the cylindrical cavity.

10. The shock sensor of claim 1 further comprising means for positioning the reed switch with respect to the shaft and the first and second surfaces.

11. A shock sensor of the type including a reed switch mounted to a housing, and a shock sensing magnetic mass biased by a spring to a first position where the reed switch is not activated and movable against the spring by acceleration to a second position where the reed switch is activated, the reed switch defining an axis, the improvement comprising:

a first shaft positioned parallel to and spaced from the reed switch in a direction perpendicular to the axis; and portions of the magnet defining a central hole, wherein the shaft extends through the magnet central hole and the magnet is slidable on the shaft between a first position which does not actuate the reed switch, and a second position which actuates the reed switch.

12. The shock sensor of claim 11 further comprising:

a second shaft positioned parallel to the reed switch and the first shaft, a second magnet having portions defining a central hole, the second shaft positioned within the hole and the second magnet slidable on the second shaft; and a second spring biasing the second magnet to a position which does not actuate the reed switch, wherein the second magnet is slidable on the shaft in response to an acceleration force opposite in direction than the acceleration force which causes the first magnet to move along the first shaft.

13. An automotive shock sensor comprising:

a first housing;

a reed switch defining an axis and connected to the first housing;

a first shaft fixed to the first housing, the first shaft extending substantially parallel to the reed switch axis, and being spaced sidewardly from the reed switch;

a first magnet mounted on the shaft for movement along the shaft between a first abutment and a second abutment, the second abutment being directed toward the front of an automobile; and a first spring positioned on the shaft between the first magnet and the second abutment, wherein the first spring biases the first magnet against the first abutment when the first housing is not subjected to an axial accelerative force, and wherein a front end collision drives the first magnet toward the second abutment to thereby actuate the reed switch.

14. The automotive shock sensor of claim 13 further comprising;

a second housing connected to the first housing, wherein the reed switch is positioned between the first housing and the second housing;

a second shaft connected to the second housing, the second shaft extending approximately parallel to the reed switch axis and spaced perpendicular to the axis;

a second magnet positioned on the second shaft for movement along the shaft between a second shaft first abutment and a second shaft second abutment, the second shaft second abutment being directed toward the rear of an automobile; and a second spring positioned on the second shaft between the second magnet and the second shaft second abutment, wherein the second spring biases the second magnet against the second shaft first abutment when the second housing is not subjected to an axial accelerative force, and wherein a rear end collision drives the second magnet toward the second shaft second abutment to thereby actuate the reed switch.

* * * * *